United States Patent [19]

Fujisawa

[11] Patent Number: 4,806,187

[45] Date of Patent: Feb. 21, 1989

[54] METHOD AND APPARATUS FOR SUCCESSIVELY APPLYING THERMOSHRINKABLE TUBULAR LABELS TO CONTAINERS

[75] Inventor: Shotaro Fujisawa, Uji, Japan

[73] Assignee: Fujiyama Giken Co., Ltd., Japan

[21] Appl. No.: 176,648

[22] PCT Filed: Jun. 12, 1987

[86] PCT No.: PCT/JP87/00379

§ 371 Date: Feb. 11, 1988

§ 102(e) Date: Feb. 11, 1988

[87] PCT Pub. No.: WO87/07878

PCT Pub. Date: Dec. 30, 1987

[51] Int. Cl.[4] ..... B32B 31/00

[52] U.S. Cl. ..... 156/86; 53/291; 53/297; 53/585; 156/521

[58] Field of Search ..... 156/86, 521; 53/291, 53/295, 296, 442, 567, 585, 297, 292, 298

[56] References Cited

U.S. PATENT DOCUMENTS

| | | | |
|---|---|---|---|
| 3,974,628 | 8/1976 | Konstantin | 53/291 |
| 4,179,863 | 12/1979 | Fresnel | 53/295 |
| 4,208,857 | 6/1980 | Fujio | 156/86 |
| 4,545,181 | 10/1985 | Frankefurt | 53/585 |

FOREIGN PATENT DOCUMENTS

| | | |
|---|---|---|
| 57-1111 | 1/1982 | Japan . |
| 59-84728 | 5/1984 | Japan . |

*Primary Examiner*—Michael W. Ball
*Assistant Examiner*—Steven D. Maki
*Attorney, Agent, or Firm*—Franklin D. Wolffe; Morris Fidelman

[57] ABSTRACT

This invention provides a method and apparatus for automatically and successively applying thermoshrinkable tubular labels, cap seals or the like to the outer circumferential surfaces of bottles and other containers.

A thermoshrinkable web 1in a flat condition is fed by feed rollers 11, 11 intermittently a predetermined length, and after the pleats 3, 3 at the opposite lateral edges of the web have been smoothed out and spaces 4, 4 have been formed in the web along the lateral edges, the web is fed onto the wedge-shaped upper portion 15 of an insertion guide 14 and cut by cutting means into a required length. The cut tubular label 1 is intermittently fed by feed belts 21, 21 from the wedge-shaped portion 15 of the insertion guide 14 onto the lower portion thereof having substantially the same shape in transverse section as a container 20, and after having been reformed into substantially the same shape in transverse section as the container 20, the tubular label is applied to the container 20.

The insertion guide 14 is supported alternately at an upper and a lower position by a guide supporting mechanism provided with upper support pins 26, 26 and lower support pins 29, 29 which can be inserted into the upper support holes 18*a*, 18*a* and the lower support holes 18*b*, 18*b*, respectively, formed on each of the opposite side surfaces of the insertion guide, and in timed relation to the alternate supporting operation the feed rollers 11, 11, the cutting means, the feed belts 21, 21, etc. are operated.

3 Claims, 2 Drawing Sheets

METHOD AND APPARATUS FOR SUCCESSIVELY APPLYING THERMOSHRINKABLE TUBULAR LABELS TO CONTAINERS

TECHNICAL FIELD

This invention relates to a method and apparatus for automatically and successively applying tubular pieces of thermoshrinkable material such as labels, cap seals or the like to the outer circumferential surfaces of bottles and other containers.

BACKGROUND ART

There is known in the prior art an apparatus disclosed in Japanese Patent Application No. 59-238769 (Unexamined Patent Publication No. 61-115825) filed Nov. 12, 1984 in the name of the present applicant.

This apparatus known in the prior art is provided with a plurality of label applying heads arranged in a rotary manner so that the applying heads apply labels to the bodies of the bottles on a table during one rotation thereof. In this arrangement, a label of a predetermined length is successively cut from a tubular web of thermoshrinkable material folded flat, and the opposite surfaces of the label are sucked by suction pads arranged at the opposite sides thereof. A label applying guide comprising a pair of claws made of a thin plate is inserted from the underside of the tubular label into the space formed in the label by the application of suction thereto, and a bottle fed from below by a lifting table is inserted into the space of the label broadened by the claws. Finally, under the condition that the tubular label is pressed against the body of the bottle by a label presser the claws are pulled out from inside the tubular label so as to apply the tubular label to the body of the bottle.

The above-mentioned prior art apparatus has a characteristic of a high-speed machine and requires as many suction pads, applying guides, label pressers, lifting tables and other devices as there are bottle stations on the rotary mechanism. To operate there devices in timed relation to each other, a large driving power and vacuum pumps are also required. As a result, the apparatus is complicated in construction and very expensive and is not ready to deal with bottles or tubular labels of different sizes.

The object of this invention is to provide a method and apparatus for successively applying thermoshrinkable tubular labels to bottles and other containers, which can easily be adjusted to deal with labels of different sizes and shapes by replacement of a minimum number of parts and subsequent adjustment associated therewith, and which is simplified in construction and easy to handle, and in which a large reduction in cost has been achieved.

DISCLOSURE OF THE INVENTION

The method of successively applying thermoshrinkable tubular labels to containers in accordance with the invention comprises: a step of feeding a thermoshrinkable tubular web which has been paid out in a flat condition; a step of smoothing out the pleats at the opposite lateral edges of the web that has been fed and forming a space therein; a step of covering with the thermoshrinkable tubular web with a space formed therein the upper portion of an insertion guide comprising a wedge-shaped upper portion and a lower portion of substantially the same shape in transverse section as that of a container; a step of cutting the thermoshrinkable tubular web covering the upper portion of the insertion guide into a tubular label of a predetermined length; a step of moving the thermoshrinkable tubular label cut to the predetermined length from the upper to the lower portion of the insertion guide by a pair of feed belts pressed against the side surfaces of the insertion guide; a step of feeding a container to a predetermined position below the insertion guide; and a step of moving by the feed belts the thermoshrinkable tubular label that has been moved to the lower portion of the insertion guide downwardly of the insertion guide and applying the tubular label to the container that has been fed to the predetermined position below the insertion guide while simultaneously reforming the tubular label to substantially the same shape in transverse section as the container.

The apparatus for successively applying thermoshrinkable tubular labels to containers in accordance with the present invention comprises: feed rollers for intermittently feeding a thermoshrinkable tubular web which has been paid out a predetermined length in a flat condition; space forming means arranged above or below the feed rollers for smoothing out the pleats at the opposite lateral edges of at least the lower portion of the thermoshrinkable tubular web and simultaneously forming a space therein; cutting means arranged below the space forming means for cutting the thermoshrinkable tubular web into a tubular label of a predetermined length; an insertion guide arranged below the cutting means for guiding the thermoshrinkable tubular label onto a container and comprising a wedge-shaped upper portion and a lower portion of substantially the same shape in transverse section as that of the container, with a pair of horns at the opposite ends of the upper edge of the insertion guide and an upper and a lower pair of support holes in each side surface of the insertion guide; guide supporting means arranged along each side surface of the insertion guide and provided with an upper and a lower pair of support pins arranged for alternate insertion into the upper and the lower pair of support holes thereby to support the insertion guide alternately at an upper and a lower position thereof; feed belts extending in a vertical direction along the opposite side surfaces of the insertion guide and urged into contact therewith for intermittently feeding the thermoshrinkable tubular label from the upper portion of the insertion guide to the container in timed relation to the alternate supporting of the insertion guide by the upper and lower support pins; and container feeding means for feeding a container to a predetermined position below the insertion guide. As compared with the previously mentioned prior art apparatus, the apparatus of the invention is a medium-speed machine.

As mentioned above, in accordance with the present invention a single insertion guide is used for guiding a thermoshrinkable tubular label to a container to be applied thereto, and after having been reformed to substantially the same shape in transverse section as the container, the tubular label is instantaneously applied to a predetermined position on the container by means of the feed belts pressed against the opposite side surfaces of the insertion guide. Therefore, in accordance with the invention linear feeding of containers by a conveyor and a single label applying mechanism suffice, with a resulting advantage that the construction of the apparatus is very much simplified and the cost is greatly reduced. Also, in accordance with the invention the construction of the apparatus is simple as mentioned above, so that the apparatus seldom gets out of order and its maintenance is easy.

Furthermore, in accordance with the invention replacement of the insertion guide or a part thereof by a different one suffices for dealing with containers or tubular labels of different sizes or shapes in transverse section, so that the apparatus can be promptly adapted for application of a small number of labels of different types. The apparatus finds especially high utility in industry.

BRIEF DESCRIPTION OF THE DRAWINGS

The drawings show one embodiment of the labeling apparatus according to the present invention.

BEST MODE FOR EMBODYING THE INVENTION

The present invention will be explained below in further detail with reference to the drawings which show an example in which tubular labels of thermoshrinkable material are successively applied to containers in the form of bottles.

Figure 1:
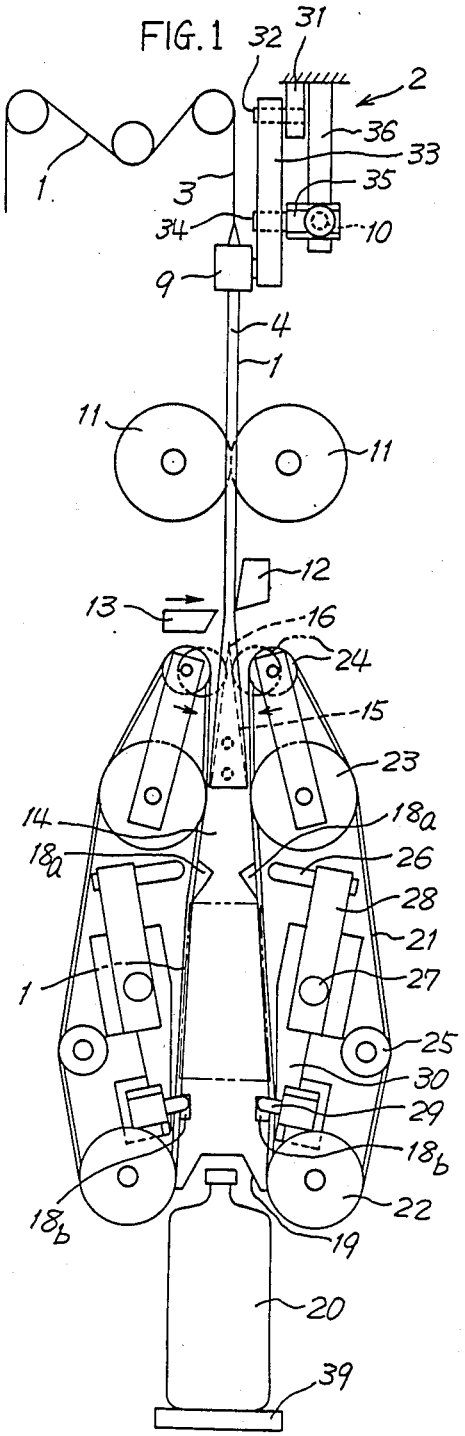
FIG. 1 is a front view of the apparatus.
Figure 2:
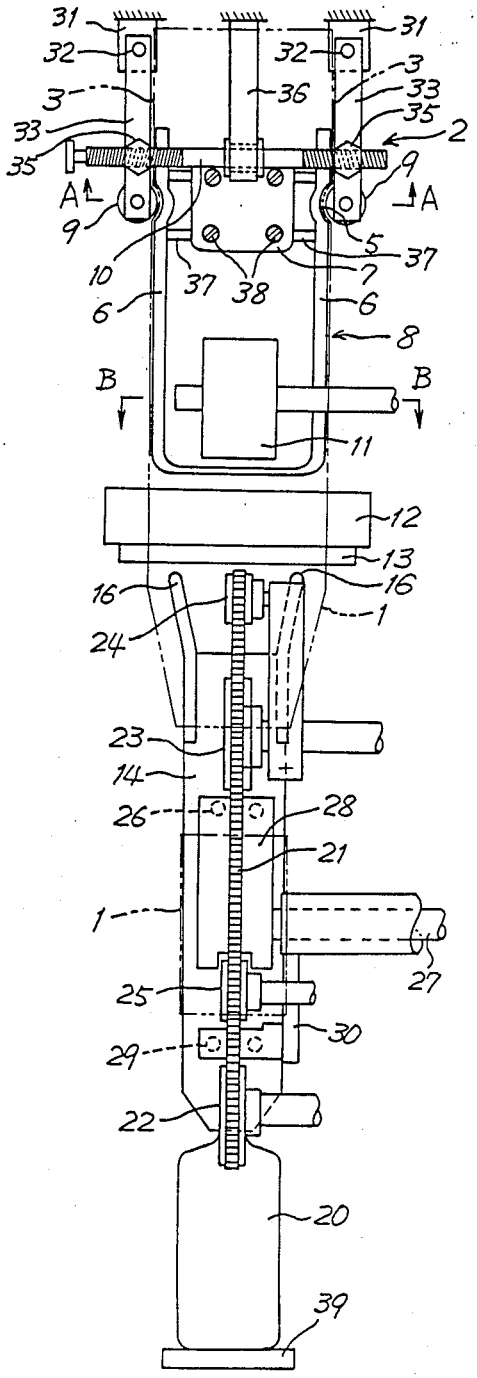
FIG. 2 is a side view of the apparatus.
Figure 5:
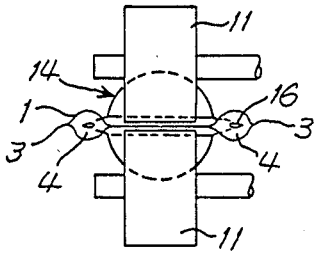
FIG. 5 is a sectional view of the apparatus taken along line B—B in FIG. 2.

As shown in FIGS. 1 and 2, a tubular web 1 of thermoshrinkable plastic film for use as labels, which is flat and wound into a roll (not shown), is paid out of the roll and led to a space former 2 in the labeling apparatus of the invention. The space former 2 smoothes out the pleats 3, 3 at the opposite lateral edges of the flat tubular web 1 and simultaneously expands the lateral edge portions thereof slightly thereby to form round spaces 4, 4 in the lateral edge portions of the web, with the middle portion of the web being held between feed rollers 11, 11 contacting the opposite side surfaces of the web as shown in FIG. 5.

Figure 4:
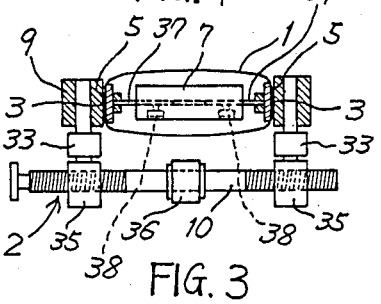
FIG. 4 is a sectional view of the apparatus taken along line A—A in FIG. 2.
Figure 6:
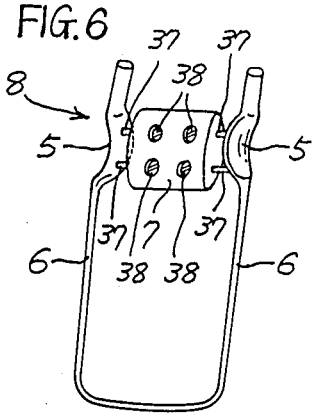
FIG. 6 is a perspective view of a pleat smoother.

As shown in FIGS. 2, 4 and 6, the space former 2 is composed of: a pleat smoother 8 comprising a pair of guide rods 6, 6 each having an inwardly depressed cylindrical surface 5 and connected at their lower ends to form a resilient U-shaped member which can be opened and closed and a supporting mechanism for the guide rods, and adapted for insertion into the tubular web 1 when in use; free rollers 9, 9 supported for rotation as they are slightly urged against the cylindrical surfaces 5, 5 from outside; and a supporting and space adjusting mechanism for the free rollers.

The supporting mechanism for the guide rods 6, 6 is composed of pins 37, 37 projecting from the inner side of each of the guide rods 6, 6, a support block 7 into which each pin 37 is inserted so that its position can be changed axially, and fixing bolts 38 for clamping the pins 37 to the support block 7 to fix them at a required inserted position thereby to adjust the space between the guide rods 6, 6. The space between the guide rods 6, 6 is adjusted in accordance with the size of the tubular web 1 to be used.

The supporting and space adjusting mechanism for the free rollers 9, 9 is composed of: support blocks 31, 31 with a predetermined space therebetween; support arms 33, 33 each pivoted at its upper end to each of the support blocks 31 by means of a pin 32 and supporting a free roller 9 for rotation on a shaft cantilevered to the lower end of each of the support arms; threaded sliders 35, 35 each pivoted by a pin 34 to the middle portion of each of the support arms 33; a screw rod 10 having its left and right end portions formed into oppositely threaded screws passed through the threaded holes of the sliders 35; and a support member 36 for supporting the screw rod so as to be rotatable and movable slightly in a vertical direction and not displaceable in the axial direction thereof.

The space between the free rollers 9, 9 is adjusted in order to regulate the pressure the free rollers 9, 9 exert on the cylindrical surfaces 5, 5, as well as to insert the pleat smoother 8 into the tubular web 1 and set the smoother between the free rollers. In this case, as the screw rod 10 is turned in either direction, the sliders 35, 35 are moved symmetrically toward the opposite ends of the screw rod 10 or the center thereof and the support arms 35, 35 are swung symmetrically outwardly or inwardly thereby to increase or decrease the space between the free rollers 9, 9.

With the above-mentioned space former 2, as the tubular web 1 is pulled downwardly through the space former 2, the pleats 3, 3 thereof are continuously squeezed between the free rollers 9, 9 and the cylindrical surfaces 5, 5 and flattened, and spaces 4, 4 are formed inside the tubular web 1 along the opposite lateral edges thereof.

In a different embodiment of the invention, each of the cylindrical surfaces 5, 5 of the above-mentioned pleat smoother 8 may be replaced by a roller (not shown) rotatably supported on the inwardly upper side of each of the free rollers 9, 9. In this case, the squeezing force on the pleats 3 becomes smaller, but the tubular web 1 can be pulled more smoothly out of the space former 2.

Below the previously mentioned space former 2 there are provided a pair of feed rollers 11, 11 of a smaller axial length than the width of the tubular web 1. These feed rollers 11, 11 sandwich the tubular web 1 with a pressure and operate to intermittently feed the web a predetermined length.

Below the feed rollers 11, 11 there is provided means for cutting the tubular web 1. This cutting means comprises a fixed blade 12 provided at one side of the tubular web 1 and a movable blade 13 provided at the other side of the web 1 opposite to the fixed blade and operates to cut the tubular web 1 fed by the feed rollers 11, 11 to a predetermined length as the web stops in the course of intermittent feeding of the web.

Figure 7:
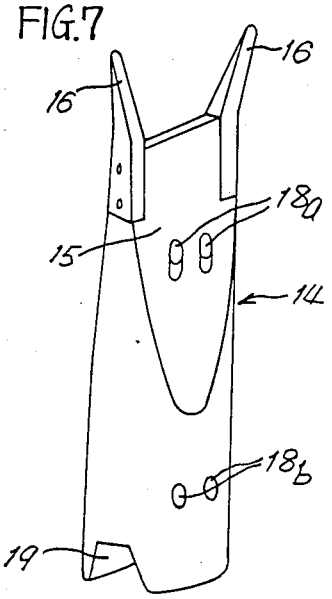
FIG. 7 is a perspective view of an insertion guide.

Below the above-mentioned cutting means there is provided an insertion guide 14. As shown in FIG. 7, the insertion guide 14 comprises a wedge-shaped upper portion 15 provided at the opposite ends of the upper edge thereof with a pair of horns 16, 16 and a lower portion of substantially the same shape in transverse section as the shoulder of a container 20 in the form of a bottle having a cylindrical body, that is, a lower portion formed into a generally cylindrical body of substantially the same diameter as the container 20, with upper support holes **18*a*, 18*a* and lower support holes 18*b*, 18*b*** being formed in the upper and lower portions of each of the opposite side surfaces of the insertion guide.

As shown in FIGS. 2 and 7, the horns 16, 16 project slightly outwardly so that their tip ends lie at the centers of the spaces 4, 4 in the lateral side portions of the tubular web 1. A recess 19 is formed in the bottom of the insertion guide 14 so that the lower end of the cylindrical body of the insertion guide 14 may be positioned as near to the body of the container 20 as possible.

The space between the upper support holes 18*a*, 18*a* and the lower support holes 18*b*, 18*b* on each side surface of the insertion guide 14 is longer than the length of a label to be severed from the tubular web 1, and to support the insertion guide 14 well balanced the upper support holes 18*a*, 18*a* are formed approximately at the middle height of the insertion guide 14.

Along the middle portion of each of the opposite side surfaces of the insertion guide 14 there is provided a feed belt 21 extending vertically. Each feed belt 21 endlessly runs around three pulleys, that is, a pulley 22 in contact with the side surface of the lower end of the insertion guide 14, a pulley 23 in contact with the side surface thereof above the upper support holes 18, and a small pulley 24 so arranged as to be brought into and out of contact with the web surface above the wedge-shaped portion 15. In addition, a tension pulley 25 is provided to adjust the tension of each feed belt 21.

The cut tubular label 1 partially covering the wedge-shaped portion 15 is moved onto the lower portion of the insertion guide 14 by driving the feed belts 21, 21 with the small pulleys 24, 24 in pressing contact with the insertion guide 14.

Figure 3:
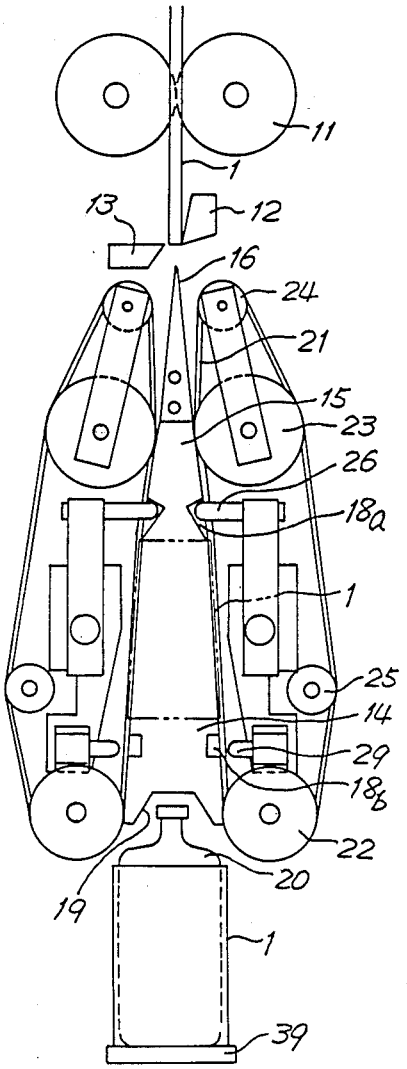
FIG. 3 is a front view of the apparatus when a thermoshrinkable tubular label is applied to a container.

Along each of the side surfaces of the insertion guide 14 there is provided a guide supporting mechanism. Each of the guide supporting mechanisms is composed of: a shaft 27 provided at an intermediate position between the pulleys 22 and 23 at each side of the insertion guide 14; an arm plate 28 mounted on the shaft 27 so as to be swingable with the shaft 27 as its axis so that the upper end of the arm plate approaches or moves away from the insertion guide 14; an arm 30 mounted on the shaft 27 so as to be swingable with the shaft 27 as its axis so that the lower end of the arm approaches or moves away from the insertion guide 14; a pair of upper support pins 26, 26 projecting from the inner surface of the upper portion of the arm plate 28; and a pair of lower support pins 29, 29 projecting from the inner surface of the lower portion of the arm 30; the upper support pins 26, 26 facing the upper support holes 18*a*, 18*a* and the lower support pins 29, 29 facing the lower support holes 18*b*, 18*b* so that the pins stradling the feed belts 21 can be inserted into and pulled out of the corresponding holes. The insertion of the upper support pins 26, 26 into the upper support holes 18*a*, 18*a* with subsequent separation of the pins from the holes and the insertion of the lower support pins 29, 29 into the lower support holes 18*b*, 18*b* with subsequent separation of the pins from the holes are alternately effected by a cam or other mechanism (not shown), so that the insertion guide 14 is suspended in midair at its opposite sides by either the upper support pins 26, 26 or the lower support pins 28, 28 as shown in FIGS. 1 and 3.

In timed relation to the above-mentioned supporting of the insertion guide 14 alternately at an upper and a lower position, the feed rollers 11, 11, the movable blade 13, the small pulleys 24, 24, etc. are operated in predetermined manners, respectively, through various types of cam and crank mechanisms (not shown).

With the labeling apparatus having the above-mentioned construction, as shown in FIGS. 1 and 2, the pleat smoother 8 is inserted into the tubular web 1 paid out of a roll (not shown) to the space former 2, and the free rollers 9, 9 are pressed against the opposite cylindrical surfaces 5, 5 of the pleat smoother 8 from outside so tht the pleat smoother 8 is suspended in midair.

Under the condition, as the tubular web 1 is pulled downwardly by the feed rollers 11, 11, the pleats 3, 3 at the opposite lateral edges of the tubular web 1 are squeezed between the free rollers 9, 9 and the pleat smoother 8 to be smoothed out, so that round spaces 4, 4 are formed in the opposite lateral portions of the tubular web 1 as shown in FIG. 5.

Then the tubular web 1 is fed onto the wedge-shaped portion 15 of the insertion guide 14 while being guided by the horns 16, 16 inserted into the spaces 4, 4 in the opposite lateral portions of the web. After that, the feeding of the tubular web 1 by the feed rollers 11, 11 is stopped temporarily, whereupon the movable blade 13 of the cutting means is driven in a direction perpendicular to the tubular web 1 to cut the web 1. At this time the lower end of the tubular web 1 lies a little above the contact points between the wedge-shaped portion 15 and the pulleys 23, 23. In the above-mentioned case, the tubular web 1 is fed by the feed rollers 11, 11 intermittently in such a manner that the length from the lower end of the tubular web 1 to the upper end thereof cut by the movable blade 13 corresponds to the length of a label required by the container 20.

After the tubular web 1 has been cut by the cutting means, the small pulleys 24, 24 are urged against the tubular web on the wedge-shaped portion 15 as shown by double-dot-and-dash lines in FIG. 1, and the feed belts 21, 21 are driven to feed the cut label 1 from the wedge-shaped portion 15 of the insertion guide 14 downwardly to the lower portion thereof as shown by double-dot-and-dash lines in FIG. 1. At this time, as shown in FIG. 1, the insertion guide 14 is supported at its opposite sides by the lower support pins 29, 29 inserted into the lower support holes 18*b*, 18*b* while the upper support pins 26, 26 are outside the upper support holes 18*a*, 18*a*, so that the above-mentioned feeding of the tubular web 1 is not prevented by the upper support pins 26, 26.

After that, the feeding of the tubular web 1 by the feed belts 21, 21 is temporarily stopped, whereupon the upper support pins 26, 26 are inserted into the upper support holes 18*a*, 18*a* and at the same time the lower support pins 29, 29 are pulled out of the lower support holes 18*b*, 18*b* and the small pulleys 24, 24 are separated from the wedge-shaped portion 15 as shown in FIG. 3. Under the condition, the feed belts 21, 21 are again driven for circulation, whereupon the tubular label 1 is reformed into a hollow cylindrical shape of substantially the same diameter as the container 20 and removed from the lower end of the insertion guide 14 onto the container 20 previously positioned below the insertion guide to cover the body thereof instantaneously and without fail as shown in FIG. 3. At this time, as shown in FIG. 3, the insertion guide 14 is supported at the opposite sides thereof by the upper support pins 26, 26 inserted into the upper support holes 18*a*, 18*a* while the lower support pins 29, 29 are outside the lower support holes 18*b*, 18*b*, so that the above-mentioned feeding of the tubular label 1 is not prevented by the lower support pins 29, 29.

In timed relation to the above-mentioned operation of the various parts, the next feeding of the tubular web 1 by the feed rollers 11, 11 is effected as shown in FIG. 1, so that the tubular web 1 covers the wedge-shaped portion 15 of the insertion guide 14, and the upper support pins 26, 26 are separted from the upper support holes 18*a*, 18*a*, and at the same time the lower support pins 29, 29 are inserted into the lower support holes 18*b*, 18*b*, with the above-mentioned steps of operation being repeated. In synchronism with the above-mentioned operation of the various parts, containers 20 are successively fed to a position immediately below the insertion guide 14 by a container feeder in the form of a conveyor 39.

In the above arrangement, in case a tubular label of a length smaller than the container 20 need be applied to the intermediate portion of the body of the container, a stopper (not shown) shaped like a horseshoe or otherwise may be placed beside the container 20 to support the tubular label that has been fed downwardly at a required middle position on the container. In this case, when the stopper has been removed after the application of the tubular label to the container 20, due to the resiliency of its material the label does not readily slip down but is kept at the required middle position on the body of the container 20.

To provide for tubular labels of a different diameter or length to be applied to a container 20 of a different size, the insertion guide 14 is exchanged for a different one which has a lower cylindrical portion of a different diameter or length, with a different space between the upper support holes 18*a*, 18*a* and the lower support holes 18*b*, 18*b* and by adjusting the space between the upper support pins 26, 26 and the lower support pins 29, 29, etc. to suit with the new insertion guide, it is easy to adapt the machine for labels of different dimensions.

In case the body of the container 20 is not circular in transverse section, an insertion guide 14 which has at least the lower end portion of its lower part formed into a shape in transverse section not circular but substantially the same as the body of the container 20 may be used to smoothly apply to a container 20 a tubular label previously adjusted to substantially the same shape in transverse section as the body of the container 20. In this case, that part of the lower end portion of the insertion guide 14 which functions to reform the tubular label to substantially the same shape in transverse section as the body of the container may be either an integral part of the body of the insertion guide 14 or a separate part which can be attached by screws or the like to and detached from the body of the insertion guide 14.

Needless to say, the labeling method and apparatus in accordance with the invention can be adapted for application of a tubular web not only as a label to the body of a container 20 but also as a cap seal to the sealed portion between the cap and the body of a container 20.

POSSIBLE INDUSTRIAL APPLICATIONS

As mentioned above, the method and apparatus for successively applying thermoshrinkable tubular labels to containers in accordance with the invention are useful in successively applying thermoshrinkable tubular labels to the outer circumferential surfaces of bottles or other containers and can effectively be used to apply a tubular label to the body of a container or a tubular cap seal to the sealed portion between the body and the cap of a container.

I claim:

1. A method of successively applying thermoshrinkable tubular labels to containers, comprising: a step of feeding a thermoshrinkable tubular web which has been paid out in a flat condition; a step of smoothing out the pleats at the opposite lateral edges of the web that has been fed and simultaneously forming spaces at opposite lateral edges thereof; a step of placing the thermoshrinkable tubular web having said spaces formed therein on a wedge-shaped upper portion of an insertion guide shaped to correspond to the shape of said spaces and having a lower portion of substantially the same shape in transverse section as that of a container; a step of cutting the thermoshrinkable tubular web covering the upper portion of the insertion guide into a tubular label of a predetermined length; a step of moving the thermoshrinkable tubular label cut to the predetermined length from the upper to the lower portion of the insertion guide by a pair of feed belts pressed against the side surfaces of the insertion guide; a step of feeding a container to a predetermined position below the insertion guide; and a step of moving by the feed belts the thermoshrinkable tubular label that has been moved to the lower portion of the insertion guide downwardly of the insertion guide and applying the tubular label to a predetermined position on the outer circumferential surface of the container that has been fed to the predetermined position below the insertion guide while simultaneously reforming the tubular label to substantially the same shape in transverse section as the container.

2. An apparatus for successively applying thermoshrinkable tubular labels to containers, comprising: feed rollers for intermittently feeding a thermoshrinkable tubular web which has been paid out a predetermined length in a flat condition; space forming means arranged above or below the feed rollers for smoothing out the pleats at the opposite lateral edges of at least the lower portion of the thermoshrinkable tubular web and simultaneously forming spaces at the opposite lateral edges thereof; cutting means arranged below the space forming means for cutting the thermoshrinkable tubular web into a tubular label of a predetermined length; an insertion guide arranged below the cutting means for guiding the thermoshrinkable tubular label onto a container and comprising a wedge-shaped upper portion and a lower portion of substantially the same shape in transverse section as that of the container, with a pair of horns at the opposite lateral ends of the upper edge of the insertion guide and an upper and a lower pair of support holes in each side surface of the insertion guide; guide supporting means arranged along each side surface of the insertion guide and provided with an upper and a lower pair of support pins arranged for alternate insertion into the upper and the lower pair of support holes thereby to support the insertion guide alternately at an upper and a lower position thereof; feed belts extending in a vertical direction along the opposite side surfaces of the insertion guide and urged into contact therewith for intermittently feeding the thermoshrinkable tubular label from the upper portion of the insertion guide to the container in timed relation to the alternate supporting of the insertion guide by the upper and lower support pins; and container feeding means for feeding a container to a predetermined position below the insertion guide.

3. The apparatus for successively applying thermoshrinkable tubular labels to containers as described in claim 2, wherein at least the lower end portion of the lower part of the insertion guide is separable.

* * * * *